United States Patent [19]

Spurling

[11] Patent Number: 4,579,197

[45] Date of Patent: Apr. 1, 1986

[54] LADDER SHIELD

[76] Inventor: Charles Spurling, 7 Indian Path, North Grafton, Mass. 01536

[21] Appl. No.: 672,134

[22] Filed: Nov. 16, 1984

[51] Int. Cl.[4] ..... E06C 5/32; E06C 7/00

[52] U.S. Cl. ..... 182/106; 182/20; 182/230

[58] Field of Search ..... 182/106, 230, 20, 129

[56] References Cited

U.S. PATENT DOCUMENTS 4,181,195 1/1980 Clarke ..... 182/106

4,236,603 12/1980 Talley ..... 182/204

FOREIGN PATENT DOCUMENTS 0061358 9/1982 European Pat. Off. ..... 182/106

*Primary Examiner*—Reinaldo P. Machado

*Attorney, Agent, or Firm*—Irving M. Kriegsman

[57] ABSTRACT

A ladder shield for use in preventing toddlers and the like from climbing the steps of a ladder, such as an above-ground swimming pool ladder, when the ladder or the device to which the ladder is coupled is unattended is disclosed. The ladder shield comprises a rigid yet slightly flexible shell of plastic which is sized and shaped to fit around the front and sides of the ladder so as to block access to the steps on the ladder. The ladder shield is removably secured to the ladder by a removable locking bar which when inserted extends through a pair of holes in the side walls of the shield. The locking bar is secured in place by a lock. When not being used to prevent access to the steps of the ladder, the ladder shield may be used as a mini-foot wash.

8 Claims, 5 Drawing Figures

LADDER SHIELD

BACKGROUND OF THE INVENTION

The present invention relates generally to safety devices for use with ladders and more particularly to a ladder shield for use in preventing toddlers and the like from climbing the steps of a ladder, such as a ladder in an above-ground swimming pool, when the ladder or the device to which the ladder is coupled is unattended.

Over the past twenty or thirty years, swimming pools have become a very popular addition to homes throughout the country. These pools are generally of two types, namely, above-ground and in-ground pools. In the above-ground pools, access to the pool is achieved by climbing a ladder which is either fastened directly to the sides of the pool or to a deck structure located next to and above the pool. Although in-ground pools do not require a ladder to access the pool since the pool is at about ground level, users of this type of pool very often procure some type of slide device which also includes a ladder to enable a person to get to the top of the slide.

As can be appreciated, one of the major safety problems with swimming pools is in children, especially toddlers, accessing the pool on an unauthorized basis when the pool is unattended by simply climbing the steps of the ladder.

One way that people have attempted to solve this problem in the past has been to build a fence around the ladder. However, this is a rather costly solution to the problem and is only satisfactory if the fence is always locked shut when the swimming pool is not intended to be used.

Another solution has been to use a pool deck that is equipped with a pivotally mounted ladder that is normally raised but which may be lowered for use. The problems with this type of pool deck are that they are fairly expensive and that they will not eliminate the problem if the user does not raise the ladder when unauthorized or unsupervised use is to be prevented.

Still another approach has been to use a ladder that is constructed to have a set of removable steps. The main problem to this approach is that it is not useable on existing ladders but rather requires replacing the existing ladder.

Yet still another solution has been to simply remove the ladder when not being used. As can be appreciated, this solution is very impractical and time-consuming.

Accordingly, it is an object of this invention to provide a device for restricting unauthorized access to the steps of a ladder, such as a ladder in a swimming pool.

It is another object of this invention to provide a device as described above which is universally adaptable for use on most all ladders.

It is still another object of this invention to provide a device as described above which is easy and economical to manufacture and easy to install and use.

It is yet still another object of this invention to provide a device as described above which has utility even when not being used as a ladder shield on a ladder.

SUMMARY OF THE INVENTION

A removable ladder shield for use in restricting unwanted access to the steps of a ladder, such as a ladder in an above-ground swimming pool, constructed according to the teachings of the present invention comprises a shell of rigid material adapted to rest on the ladder and sized and shaped so as to cover at least a portion of the ladder from the front and extend around the sides thereof and removable locking means for removably securing the shell in place on the ladder.

Various objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENTS

Figure 1:
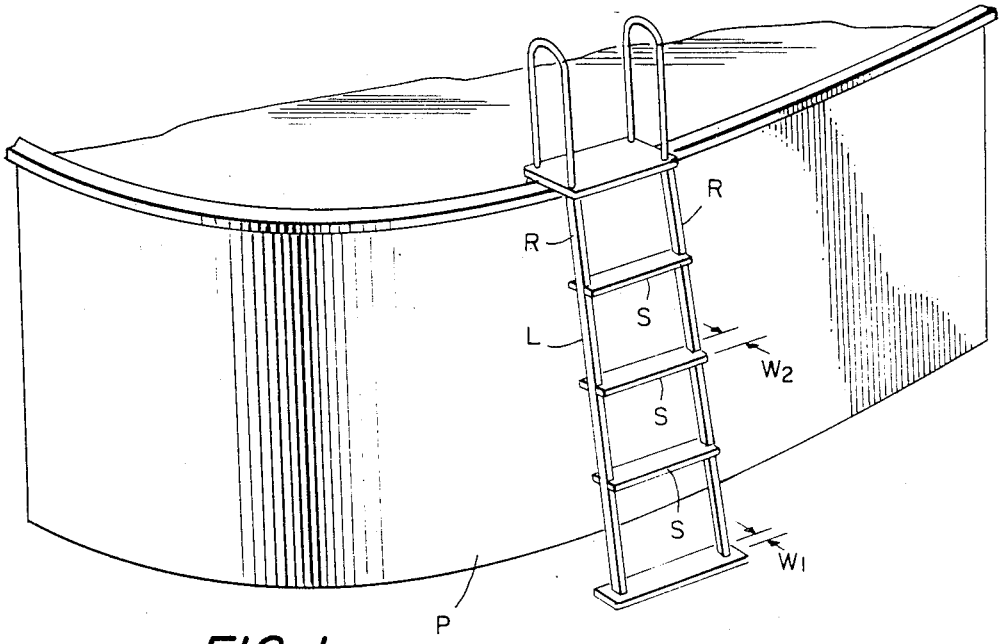
FIG. 1 is a perspective illustration of a portion of an above-ground swimming pool with a ladder attached thereto for accessing the swimming pool.
Figure 2:
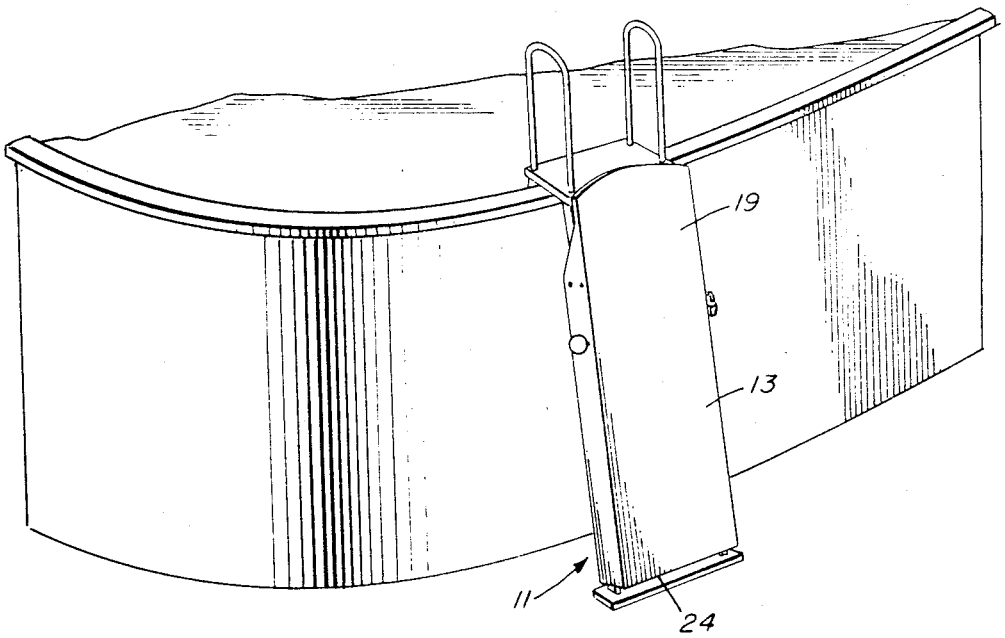
FIG. 2 is a perspective illustration of the swimming pool and ladder shown in FIG. 1 with a ladder shield constructed according to the teachings of the present invention mounted thereon.
Figure 3:
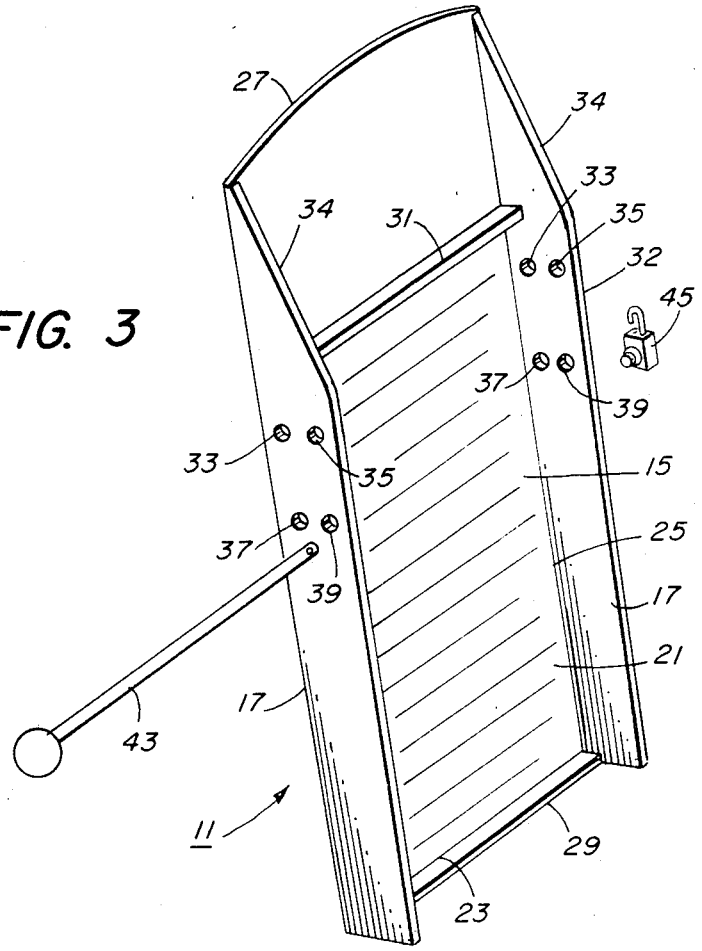
FIG. 3 is an exploded perspective view taken from the rear of the ladder shield shown in FIG. 2.
Figure 4:
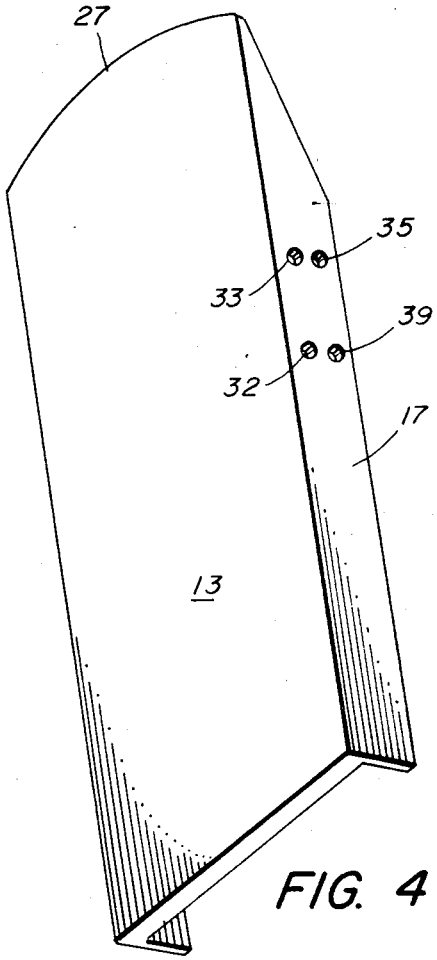
FIG. 4 is a perspective view taken from the front of the shell portion of the ladder shield shown in FIG. 2.
Figure 5:
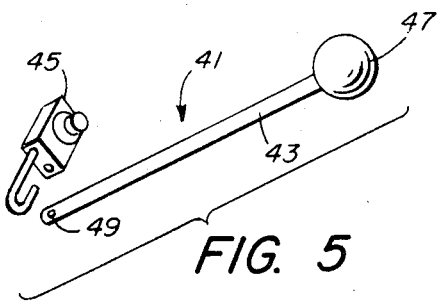
FIG. 5 is a perspective view of the components making up the locking mechanism in the ladder shield shown in FIG. 2.

Referring now to the drawings, there is shown a ladder shield constructed according to the teachings of the present invention and identified generally by reference numeral 11. Ladder shield 11 is shown in the drawings and will hereinafter be described with reference to restricting access to the steps, a ladder L in an above-ground swimming pool P since this is considered to be one important use for the invention. However, it is to be understood that the invention is useful and applicable in connection with most all types of ladders and not merely ladders on above-ground swimming pools.

Ladder shield 11 includes a shell 13 made of plastic or other suitable material which is fairly rigid yet slightly flexible. Shell 13 is sized and shaped so that it may be placed against and rest on the front of ladder L and extend around on either side of the side rails R on ladder L. The shell 13 includes a bottom wall 15 and a pair of opposed side walls 17. Side walls 17 extend upward from bottom wall 15 at an angle of around 90°.

Bottom wall 15 includes an outside surface 19, an inside surface 21, a bottom edge 24, a pair of side edges 25 and a top edge 27. Outside surface 19 is smooth, while inside surface 21 is roughened, so that a person will not slip when not stepping on it as will hereinafter be described. Bottom edge 23 and side edges 25 are straight while top edge 27 is curved or rounded. A first transverse wall 29 extends upward from bottom wall 15 at bottom edge 23 and a second transverse wall 31 extends upward from bottom wall 15 near top edge 27. Side walls 17 each include a top or outer edge 32 which slopes downward at a portion 34 near the top edge 27 of bottom wall 15. Each side wall 17 further includes a first hole 33, a second hole 35, a third hole 37 and a fourth hole 39.

Ladder shield 11 further includes a mechanism 41 for removing securing the device to the ladder with which it is being used. Mechanism 41 includes a slide bar 43 and a lock 45.

Slide bar 43 is an elongated rod made of aluminum, heavy guage plastic or other suitable material. Slide bar 43 is enlarged at one end 47 and has a lock receiving hole 49 at the other end 51. Lock 41 is a conventional lock, such as a combination lock. Slide bar 43 is circular in cross section. The cross-sectional diameter of slide bar 43 (except for the enlarged portion) is less than the diameter of holes 33, 35, 37 and 39. The enlarged portion at end 47, is greater than the diameter of holes 33, 35, 37 and 39. Thus, slide bar 43 may be inserted into holes 33, 35, 37 or 39 through one end (the non-enlarged end) only.

In use, shell 13 is placed on ladder L, as shown in the drawings, with bottom edge 23 resting on the ground or base of ladder L, and is removably secured in place so that it cannot be removed with the locking mechanism 41. The securing is achieved by inserting the slide bar 43 through one of the holes in one side wall and the corresponding hole in the other side wall and then securing slide bar 43 against withdrawal by lock 45. The particular hole used in each side wall depends on the width dimenstion $W_1$ of the side rails SR on ladder L and the width dimension $W_2$ of the steps S on ladder L. As is known, in most all above-ground swimming pool ladders the width dimension of the steps S is greater than the width dimension of the side rails R. Accordingly, the hole selected in each side wall for insertion of slide bar 43 is that hole which will enable slide bar 43 to be located behind ladder L as close as possible to Ladder L but will not allow the slide bar 43 to pass behind steps S if the ladder shield 11 is pushed up or down along the length of ladder L.

Once secured in place, ladder shield 11 cannot be removed from ladder L by being pulled backwards (without breaking the device), cannot be pushed from side to side (because of the side walls) and, at most, can only be slid up or down along the length of ladder L a distance no greater than the distance between two steps S, one steps being above slide bar 43 happens to be located and the other step being below slide bar 43.

Top edge 27 of bottom wall 15 is curved so as to make it more difficult for a toddler to grasp the top edge and pull himself up. In addition, because shell 13 is slightly flexible, any pulling on the top edge 27 by a toddler will cause the top of shell 13 to flex backward. Outer edges 32 of side wall 17 are curved at portions 34 so that those portions will not hit up against the sides of the pool P.

As noted before, shell 13 includes a pair of transverse walls 29 and 31. These two walls, together with bottom wall 15 and side walls 17, defind a generally rectangular open top container or chamber. Accordingly, when not being used as a shield, the device may be placed on the ground or other surface, filled with water and used as a foot bath to remove dirt or grass from the feet of a person prior to his climbing the ladder L to enter the pool P.

Typical dimensions for ladder shield 11 may be as follows:

| | |
|---|---|
| Height of bottom wall 15 (i.e. distance from bottom edge 23 to top of top edge 27) | 4 feet |
| Width of bottom wall 15 (i.e. distance from side walls 17) | 20 inches |
| Height of side walls 17 (i.e. before tapered portion) | 5½ inches |
| Material thickness of shell | 3/32 inches |
| Diameter of holes 33, 35, 37 and 39 | ¾ inches |
| Diameter of slide bar 41 | ½ inch |
| Thickness of Transverse Walls | 1 inch |
| Height of Transverse walls | 2 inches |

The embodiment of the present invention is intended to be merely exemplary and those skilled in the art will be able to make numerous variations and modifications to it without departing from the spirit of the present invention. All such variations and modifications are intended to be within the scope of the present invention as defined in the appended claims.

What is claimed is:

1. A ladder shield for use in preventing a person from climbing up the steps of a ladder disposed for use, the ladder comprising a pair of spaced apart side rails and a plurality of steps attached between the side rails in spaced apart relationship, the ladder shield comprising:

a. a shell of rigid material adapted to rest on the ladder from the front and dimensioned so as to cover the ladder in the front and extend around the sides of the side rails of the ladder said shell having a bottom wall for covering the ladder from the front and a pair of side walls each extending upward from the bottom wall at an angle of about 90° and extending around the sides of the side rails and having locking bar receiving openings, and b. means insertable through said locking bar receiving openings and said side walls for removably securing said shell to said ladder.

2. The ladder shield of claim 1 and wherein said bottom wall is flat includes a bottom edge, a top edge and a pair of side edges and wherein said top edge is curved.

3. The ladder shield of claim 2 and wherein each side wall includes a bottom edge and an outer edge and wherein said outer edge curves inward at the top of the ladder shield.

4. The ladder shield of claim 3 and wherein each side wall includes a hole and wherein the means for removably securing the ladder shield to the ladder comprises a locking bar adapted to extend through the holes in the side walls from one end only and a lock for locking the locking bar in place.

5. The ladder shield of claim 4 and wherein said shell is made of a slightly flexible plastic.

6. The ladder shield of claim 5 and wherein the shell further includes a pair of transverse walls extending upward from the bottom wall, one near the bottom edge and the other near the top edge, whereby said ladder shield may also be used as a container for holding water or other material when not mounted on the ladder for use.

7. The ladder shield of claim 6 and wherein the top surface of the bottom wall is rippled.

8. The ladder shield of claim 7 and wherein said side walls include additional sets of holes to accommodate different sized ladders.

* * * * *